US005785880A

United States Patent [19]

Heaslip et al.

[11] Patent Number: 5,785,880

[45] Date of Patent: Jul. 28, 1998

[54] SUBMERGED ENTRY NOZZLE

[75] Inventors: Lawrence John Heaslip, Scarborough; James Derek Dorricott, Burlington, both of Canada

[73] Assignee: Vesuvius USA, Pittsburgh, Pa.

[21] Appl. No.: 233,049

[22] Filed: Apr. 25, 1994

Related U.S. Application Data

[63] Continuation-in-part of Ser. No. 220,734, Mar. 31, 1994, abandoned.

[51] Int. Cl.[6] ..... B22D 41/50

[52] U.S. Cl. ..... 222/594; 222/606; 222/607

[58] Field of Search ..... 266/227, 236; 222/594, 606, 607

[56] References Cited

U.S. PATENT DOCUMENTS

| | | | |
|---|---|---|---|
| 4,566,614 | 1/1986 | Frykendahl | 222/606 |
| 4,671,433 | 6/1987 | Podrini et al. | 222/606 |
| 4,858,794 | 8/1989 | Sigura et al. | 222/606 |
| 5,198,126 | 3/1993 | Lee | 222/606 |
| 5,314,099 | 5/1994 | Butz et al. | 222/606 |

FOREIGN PATENT DOCUMENTS

| | | |
|---|---|---|
| 0254909 | 2/1988 | European Pat. Off. . |
| 0403808 | 12/1990 | European Pat. Off. . |
| 0482423 | 4/1992 | European Pat. Off. . |
| 3709188 | 9/1988 | Germany . |
| 4116723 | 6/1992 | Germany . |
| 4142447 | 12/1992 | Germany . |

OTHER PUBLICATIONS

International Search Report dated 31 Aug. 1995.

*Primary Examiner*—Scott Kastler

*Attorney, Agent, or Firm*—Ostrolenk, Faber, Gerb & Soffen, LLP

[57] ABSTRACT

A submerged entry nozzle for flowing liquid metal therethrough includes a vertically disposed entrance pipe section having a generally axial symmetry and a first cross-sectional flow area. A transition area having the first cross-sectional flow area with two or more front walls and two or more side walls reduces the thickness of the first cross-sectional area by providing a convergent angle of the front walls and increases the width of the first cross-sectional area by providing a divergent angle of the side walls thereby producing a second cross-sectional area of the transition area which is generally elongated and of planar symmetry. The flow of liquid metal from the transition area is divided into two streams angularly deflected from the vertical in opposite directions.

34 Claims, 9 Drawing Sheets

FIG. 1a
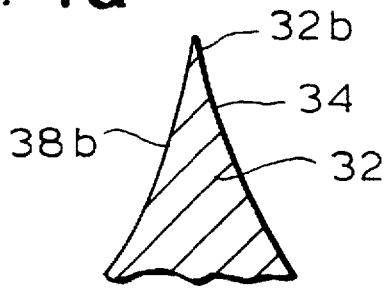
FIG. 17a
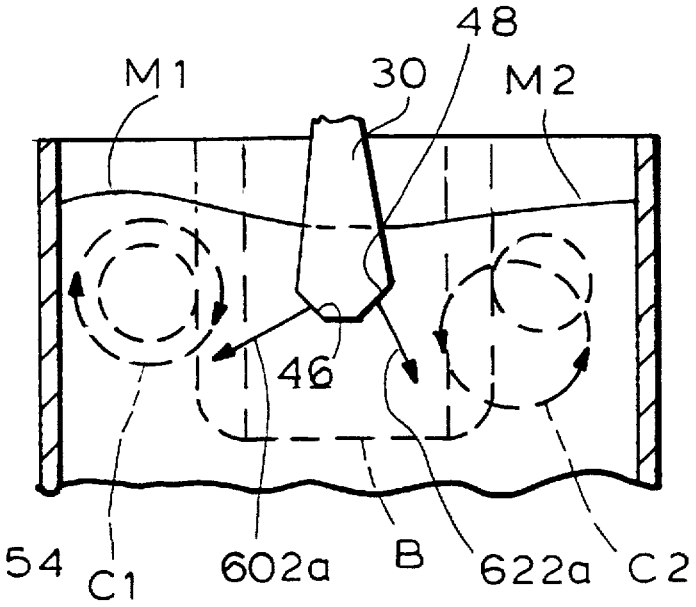
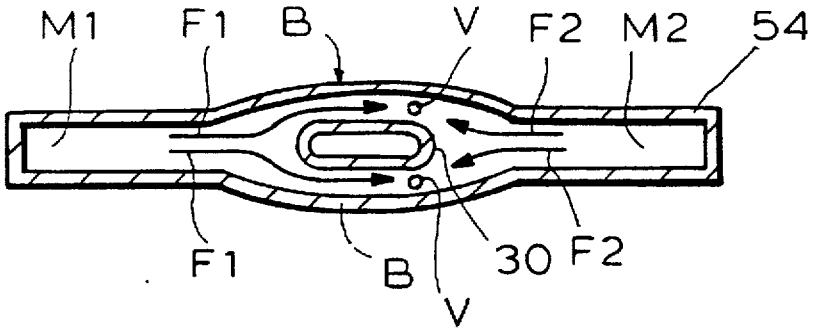
FIG. 17b

FIG. 7
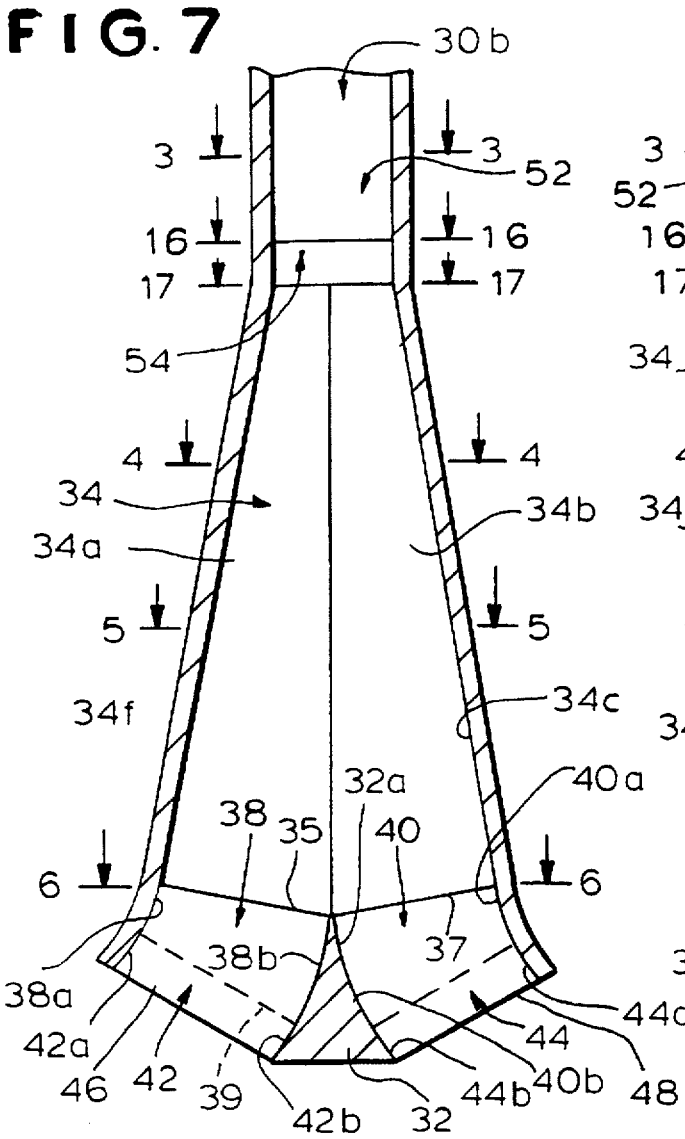
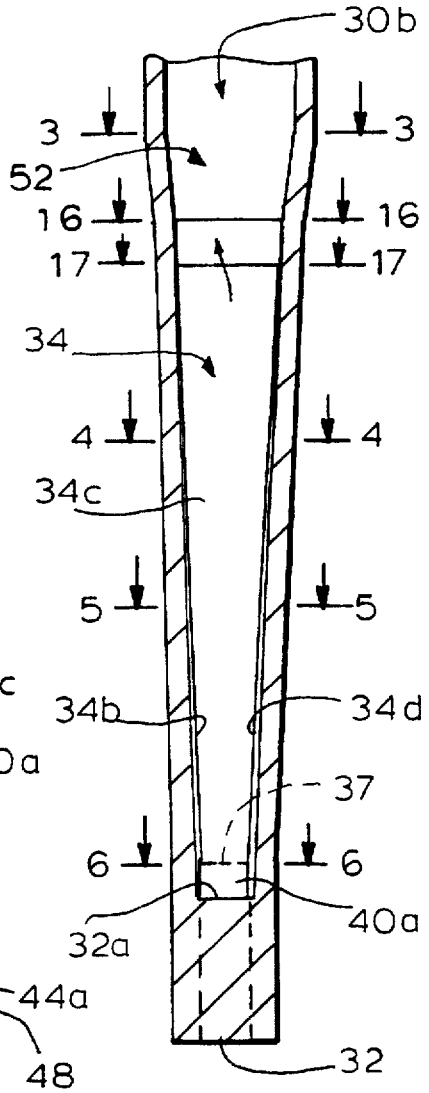
FIG. 8
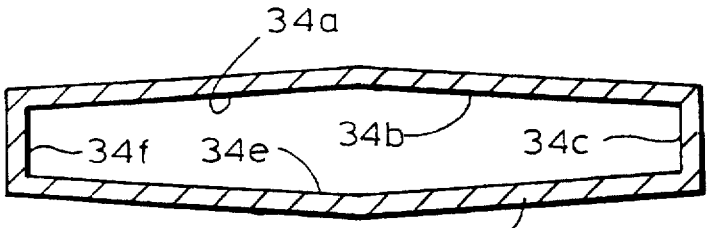
FIG. 6a
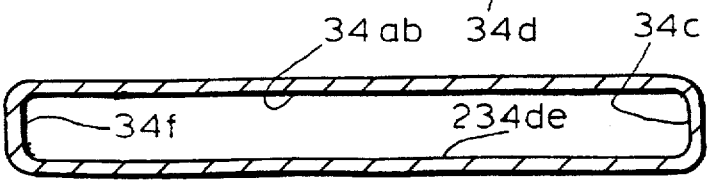
FIG. 6b 56
30b
3
S
3
19
19
58
21
21
34
34b
34a
34c
34f
52
22
22
44
32a
44a
42a
46
35
42b
32
44b
37
48

30b
3
S
3
56
19
19
34c
21
21
37
34
34d
34b
22
22
22
44a
32a
48
32

30b
3
3
4
4
34
5
5
34ab
34f
34c
37a
38
37
35a
35
6b
6b
38a
40a
42a
32a
46
44a
42
39
38b
48
40
41
42b
32
44b
44

30b
3
3
4
4
34
5
5
34c
34ab
34de
6b
37
6b
32a
40a
32

SUBMERGED ENTRY NOZZLE

This application is a continuation-in-part of application Ser. No. 08/220,734 filed Mar. 31, 1994, now abandoned.

BACKGROUND OF THE INVENTION

In the continuous casting of steel slabs having, for example, thicknesses of 50 to 60 mm and widths of 975 to 1625 mm, there is employed a submerged entry nozzle having typical outlet dimensions of 25 to 40 mm widths and 150 to 250 mm length. The nozzle generally incorporates two oppositely directed outlet ports which deflect molten steel streams at apparent angles between 10 and 90 degrees relative to the vertical. It has been found that prior art nozzles do not achieve their apparent deflection angles. Instead, the actual deflection angles are appreciably less. Furthermore, the flow profiles in the outlet ports are highly non-uniform with low flow velocity at the upper portion of the ports and high flow velocity adjacent the lower portion of the ports. These nozzles produce a relatively large standing wave in the meniscus or surface of the molten steel, which is covered with a mold flux or mold powder for the purpose of lubrication. These nozzles further produce oscillation in the standing wave wherein the meniscus adjacent one mold end alternately rises and falls and the meniscus adjacent the other mold end alternately falls and rises. Prior art nozzles also generate intermittent surface vortices. All of these effects tend to cause entrainment of mold flux in the body of the steel slab, reducing its quality. Oscillation of the standing wave causes unsteady heat transfer through the mold at or near the meniscus. This effect deleteriously affects the uniformity of steel shell formation, mold powder lubrication, and causes stress in the mold copper. These effects become more and more severe as the casting rate increases; and consequently it becomes necessary to limit the casting rate to produce steel of a desired quality.

DESCRIPTION OF THE PRIOR ART

Referring now to FIG. 17, there is shown a nozzle 30 similar to that described in European Application 0403808. As is known to the art, molten steel flows from a tundish through a valve or stopper rod into a circular inlet pipe section **30*b*. Nozzle 30 comprises a circular-to-rectangular main transition 34. The nozzle further includes a flat-plate flow divider 32 which directs the two streams at apparent plus and minus 90 degree angles relative to the vertical. However, in practice the deflection angles are only plus and minus 45 degrees. Furthermore, the flow velocity in outlet ports 46 and 48 is not uniform. Adjacent the right diverging side wall 34*c* of transition 34 the flow velocity from port 48 is relatively low as indicated by vector 627. Maximum flow velocity from port 48 occurs very near flow divider 32 as indicated by vector 622. Due to friction, the flow velocity adjacent divider 32 is slightly less, as indicated by vector 621. The non-uniform flow from outlet port 48 results in turbulence. Furthermore, the flow from ports 46 and 48 exhibit a low frequency oscillation of plus and minus 20 degrees with a period of from 20 to 60 seconds. At port 46 the maximum flow velocity is indicated by vector 602 which corresponds to vector 622 from port 48. Vector 602 oscillates between two extremes, one of which is vector 602*a*, displaced by 65 degrees from the vertical and the other of which is vector 602*b***, displaced by 25 degrees from the vertical.

As shown in FIG. **17*a*, the flows from ports 46 and 48 tend to remain 90 degrees relative to one another so that when the output from port 46 is represented by vector 602*a*, which is deflected by 65 degrees from the vertical, the output from port 48 is represented by vector 622*a* which is deflected by 25 degrees from the vertical. At one extreme of oscillation shown in FIG. 17*a*, the meniscus M1 at the left-hand end of mold 54 is considerably raised while the meniscus M2 at the right mold end is only slightly raised. The effect has been shown greatly exaggerated for purposes of clarity. Generally, the lowest level of the meniscus occurs adjacent nozzle 30. At a casting rate of three tons per minute, the meniscus generally exhibits standing waves of 18 to 30 mm in height. At the extreme of oscillation shown, there is a clockwise circulation C1 of large magnitude and low depth in the left mold end and a counter-clockwise circulation C2** of lesser magnitude and greater depth in the right mold end.

As shown in FIGS. **17*a* and 17*b*, adjacent nozzle 30 there is a mold bulge region B where the width of the mold is increased to accommodate the nozzle, which has typical refractory wall thicknesses of 19 mm. At the extreme of oscillation shown in FIG. 17*a*, there is a large surface flow F1 from left-to-right into the bulge region in front of and behind nozzle 30. There is also a small surface flow F2 from right-to-left toward the bulge region. Intermittent surface vortices V occur in the meniscus in the mold bulge region adjacent the right side of nozzle 30. The highly non-uniform velocity distribution at ports 46 and 48**, the large standing waves in the meniscus, the oscillation in the standing waves, and the surface vortices all tend to cause entrainment of mold powder or mold flux with a decrease in the quality of the cast steel. In addition, steel shell formation is unsteady and non-uniform, lubrication is detrimentally affected, and stress within mold copper at or near the meniscus is generated. All of these effects are aggravated at higher casting rates. Such prior art nozzles require that the casting rate be reduced.

Referring again to FIG. 17, the flow divider may alternately comprise an obtuse triangular wedge **32*c*** having a leading edge included angle of 156 degrees, the sides of which are disposed at angles of 12 degrees from the horizontal, as shown in a first German Application DE 3709188, which provides apparent deflection angles of plus and minus 78 degrees. However, the actual deflection angles are again approximately plus and minus 45 degrees; and the nozzle exhibits the same disadvantages as before.

Referring now to FIG. 18, nozzle 30 is similar to that shown in a second German Application DE 4142447 wherein the apparent deflection angles are said to range between 10 and 22 degrees. The flow from the inlet pipe **30*b* enters the main transition 34 which is shown as having apparent deflection angles of plus and minus 20 degrees as defined by its diverging side walls 34*c* and 34*f* and by triangular flow divider 32. If flow divider 32 were omitted, an equipotential of the resulting flow adjacent outlet ports 46 and 48 is indicated at 50. Equipotential 50 has zero curvature in the central region adjacent the axis S of pipe 30*b* and exhibits maximum curvature at its orthoganal intersection with the right and left sides 34*c* and 34*f* of the nozzle. The bulk of the flow in the center exhibits negligible deflection; and only flow adjacent the sides exhibits a deflection of plus and minus 20 degrees. In the absence of a flow divider, the mean deflections at ports 46 and 48** would be less than ¼ and perhaps ⅕ or 20% of the apparent deflection of plus and minus 20 degrees.

Neglecting wall friction for the moment, **64*a* is a combined vector and streamline representing the flow adjacent the left side 34*f* of the nozzle and 66*a*** is a combined vector and streamline representing the flow adjacent the right side 34c of the nozzle. The initial point and direction of the streamline correspond to the initial point and direction of the vector; and the length of the streamline corresponds to the length of the vector. Streamlines 64a and 66a of course disappear into the turbulence between the liquid in the mold and the liquid issuing from nozzle 30. If a short flow divider 32 is inserted, it acts substantially as a truncated body in two dimensional flow. The vector-streamlines 64 and 66 adjacent the body are of higher velocity than the vector-streamlines 64a and 66a. Streamlines 64 and 66 of course disappear into the low pressure wake downstream of flow divider 32. This low pressure wake turns the flow adjacent divider 32 downwardly. The latter German application shows the triangular divider 32 to be only 21% of the length of main transition 34. This is not sufficient to achieve anywhere near the apparent deflections, which would require a much longer triangular divider with corresponding increase in length of the main transition 34. Without sufficient lateral deflection, the molten steel tends to plunge into the mold. This increases the amplitude of the standing wave, not by an increase in height of the meniscus at the mold ends, but by an increase in the depression of the meniscus in that portion of the bulge in front of and behind the nozzle where flow therefrom entrains liquid from such portion of the bulge and produces negative pressures.

The prior art nozzles attempt to deflect the streams by positive pressures between the streams, as provided by a flow divider.

Due to vagaries in manufacture of the nozzle, the lack of the provision of deceleration or diffusion of the flow upstream of flow division and to low frequency oscillation in the flows emanating from ports 46 and 48, the center streamline of the flow will not generally strike the point of triangular flow divider 32 of FIG. 18. Instead, the stagnation point generally lies on one side or the other of divider 32. For example, if the stagnation point is on the left side of divider 32 then there occurs a laminar separation of flow on the right side of divider 32. The separation "bubble" decreases the angular deflection of flow on the right side of divider 32 and introduces further turbulence in the flow from port 48.

SUMMARY OF THE INVENTION

One object of our invention is to provide a submerged entry nozzle wherein deflection of the streams is accomplished in part by negative pressures applied to the outer portions of the streams, as by curved terminal bending sections, to render the velocity distribution in the outlet ports more uniform.

A second object of our invention is to provide a submerged entry nozzle having a main transition from circular cross-section containing a flow of axial symmetry, to an elongated cross-section with a thickness which is less than the diameter of the circular cross-section and a width which is greater than the diameter of the circular cross-section containing a flow of planar symmetry with generally uniform velocity distribution throughout the transition neglecting wall friction.

Another object of our invention is to provide a submerged entry nozzle having a hexagonal cross-section of the main transition to increase the efficiency of flow deflections within the main transition.

A further object of our invention is to provide a submerged entry nozzle having diffusion between the inlet pipe and the outlet ports to decrease the velocity of flow from the ports and reduce turbulence.

A further object of our invention is to provide a submerged entry nozzle having diffusion or deceleration of the flow within the main transition of cross-section to decrease the velocity of the flow from the ports and improve the steadiness of velocity and uniformity of velocity of streamlines at the ports.

A still further object of our invention is to provide a submerged entry nozzle having a flow divider provided with a rounded leading edge to permit variation in stagnation point without flow separation.

Other feature and objects of our invention will become apparent from the following description of the invention which refers to the accompanying drawings.

BRIEF DESCRIPTION OF THE DRAWINGS

In the accompanying drawings which form part of the instant specification and which are to be read in conjunction therewith and in which like reference numerals are used to indicate like parts in the various views:

FIG. 1a is a fragmentary cross-section looking rearwardly of a preferred flow divider having a rounded leading edge.

FIG. 3a is a cross-section taken in the plane 3a—3a of FIGS. 1b and 2a.

FIG. 4a is a cross-section taken in the plane 4a—4a of FIGS. 1b and 2a.

FIG. 6a is an alternative cross-section taken in the plane 6—6 of FIGS. 1 and 2, looking downwardly.

FIG. 6b is a cross-section taken in the plane 6—6 of FIGS. 13 AND 14 AND OF FIGS. 15 and 16, looking downwardly.

FIG. 6c is a cross-section taken in the 6c—6c of FIGS. 1b and 2a.

FIG. 7 is an axial sectional view looking rearwardly of a second submerged entry nozzle having a constant area round-to-rectangular transition, a hexagonal small-angle diverging main transition with diffusion, and moderate terminal bending.

FIG. 8 is an axial sectional view looking to the right of the nozzle of FIG. 7.

FIG. 17*a* is a sectional view, looking rearwardly, showing the mold flow patterns produced by the nozzle of FIG. 17.

FIG. 17*b* is a cross-section in the curvilinear plane of the meniscus, looking downwardly, and showing the surface flow patterns produced by the nozzle of FIG. 17.

DESCRIPTION OF THE PREFERRED EMBODIMENTS

Figure 1:
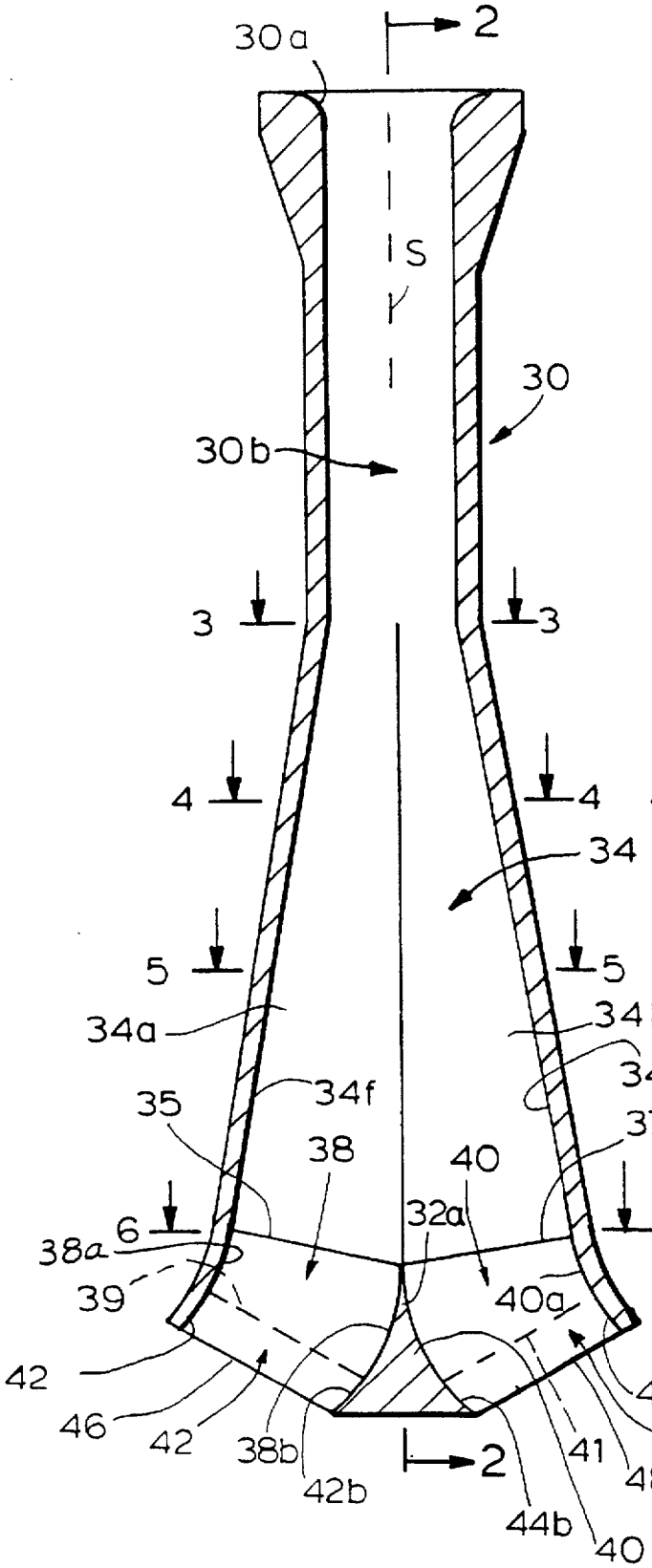
FIG. 1 is an axial sectional view looking rearwardly taken along the line 1—1 of FIG. 2 of a first submerged entry nozzle having a hexagonal small-angle diverging main transition with diffusion, and moderate terminal bending.
Figures 1B, 2A:
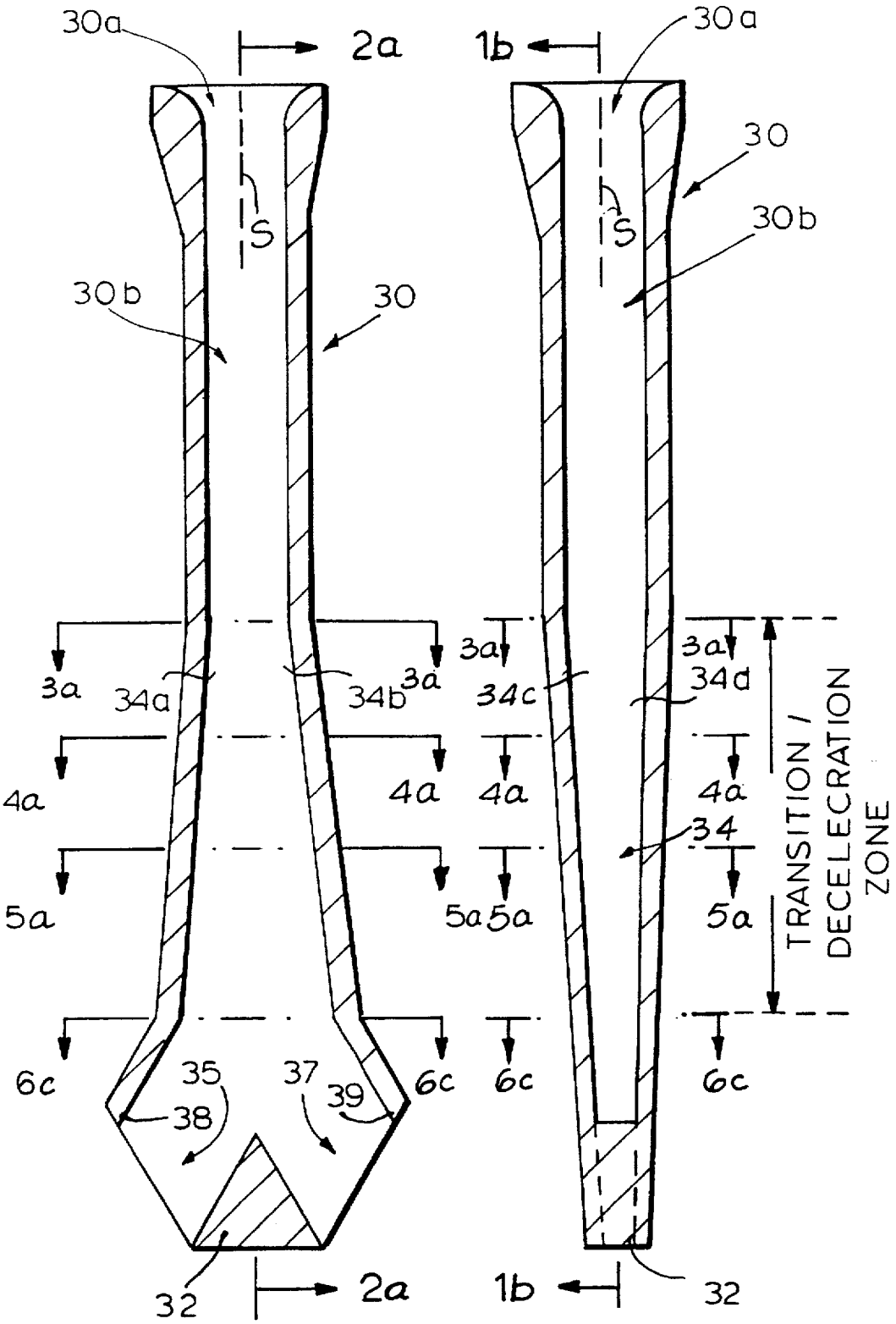
FIG. 1b is an alternate axial sectional view taken along the line 1b—1b of FIG. 2a of an alternate embodiment of a submerged entry nozzle, having a main transition with deceleration and diffusion, and deflection of the outlet flows.
FIG. 2a is an axial sectional view taken along the line 2a—2a of FIG. 1b.
Figure 3:
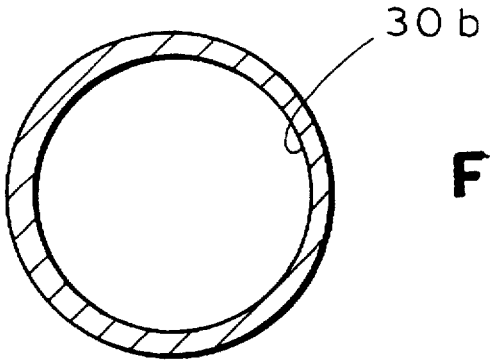
FIG. 3 is a cross-section taken in the plane 3—3 of FIGS. 1 and 2, looking downwardly.
Figure 3A:
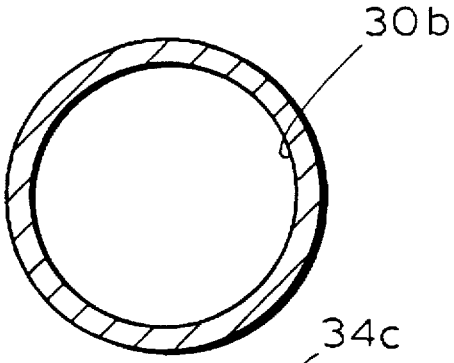

Referring now to FIGS. 1*b* and 2*a*, the submerged entry nozzle is indicated generally by the reference numeral 30. The upper end of the nozzle includes an entry nozzle 30*a* terminating in a circular pipe 30*b* which extends downwardly, as shown in FIGS. 1*b* and 2*a*. The axis of pipe section 30*b* is considered as the axis S of the nozzle. Pipe section 30*b* terminates at the plane 3*a*—3*a* which, as can be seen from FIG. 3*a*, is of circular cross-section. The flow then enters the main transition indicated generally by the reference numeral 34 and preferably having four walls 34*a* through 34*d*. Side walls 34*a* and 34*b* each diverge at an angle from the vertical. Front walls 34*c* and 34*d* converge with rear walls 34*a* and 34*b*. It should be realized by those skilled in the art that the transition area 34 can be of any shape or cross-sectional area of planar symmetry and need not be limited to a shape having the number of walls (four of six walls) or cross-sectional areas set forth herein just so long as the transition area 34 changes from a generally round cross-sectional area to a generally elongated cross-sectional area of planar symmetry, see FIGS. 3*a*, 4*a*, 5*a*, 6*c*.

For a conical two-dimensional diffuser, it is customary to limit the included angle of the cone to approximately 8 degrees to avoid undue pressure loss due to incipient separation of flow. Correspondingly, for a one-dimensional rectangular diffuser, wherein one pair of opposed walls are parallel, the other pair of opposed walls should diverge at an included angle of not more than 16 degrees; that is, plus 8 degrees from the axis for one wall and minus 8 degrees from the axis for the opposite wall. For example, in the diffusing main transition 34 of FIG. 1*b*, a 2.65 degree mean convergence of the front walls and a 5.2 degree divergence of side walls yields an equivalent one-dimensional divergence of the side walls of 10.4–5.3=5.1 degrees, approximately, which is less than the 8 degree limit.

Figure 4:
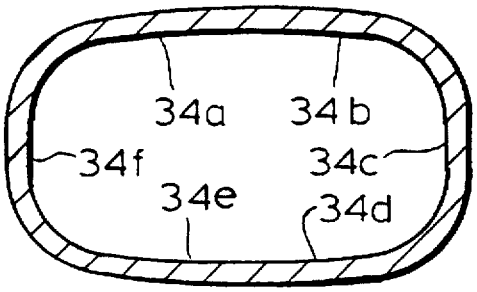
FIG. 4 is a cross-section taken in the plane 4—4 of FIGS. 1 and 2, looking downwardly.
Figure 5:
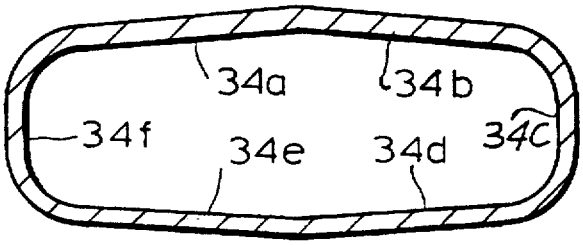
FIG. 5 is a cross-section taken in the plane 5—5 of FIGS. 1 and 2, looking downwardly.
Figure 6:
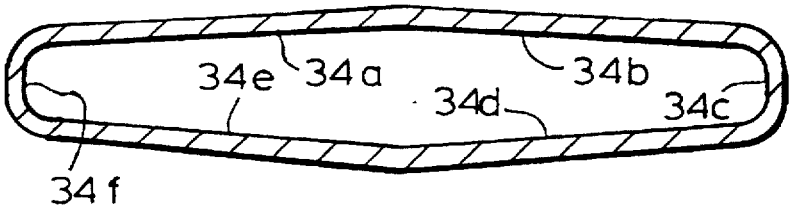
FIG. 6 is a cross-section taken in the plane 6—6 of FIGS. 1 and 2, looking downwardly.
Figure 4A:
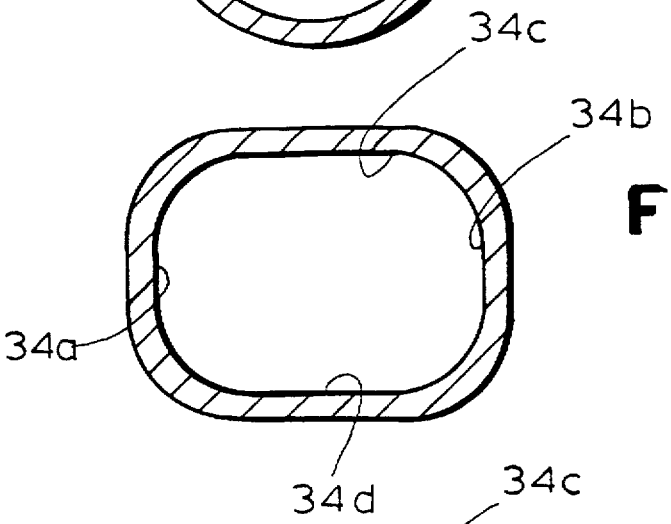
Figure 5A:
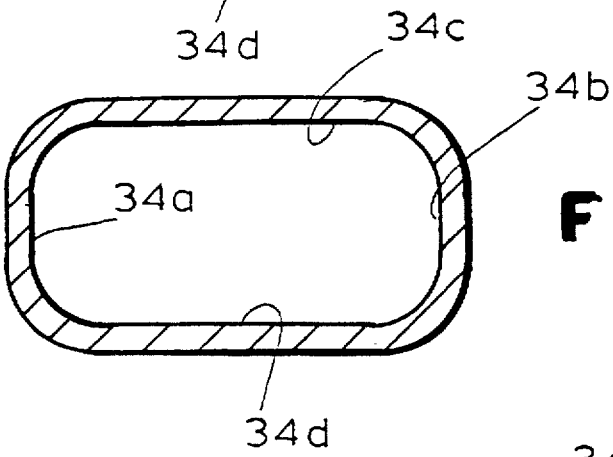
FIG. 5a is a cross-section taken in the plane 5a—5a of FIGS. 1b and 2b.
Figure 6C:
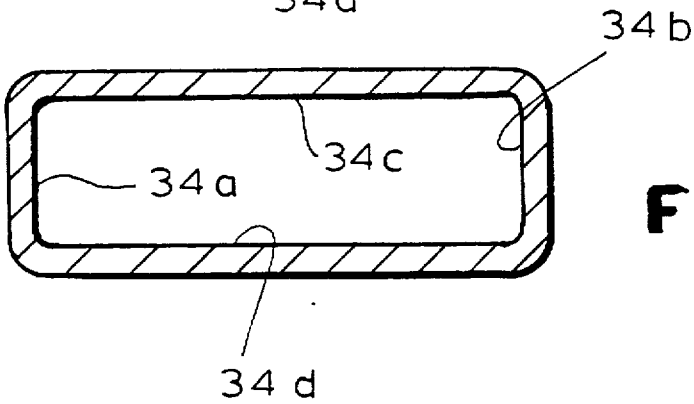

FIGS. 4*a*, 5*a* and 6*c* are cross-sections taken in the respective planes 4*a*—4*b*, 5*a*—5*a* and 6*c*—6*c* of FIGS. 1*b* and 2*a*, which are respectively disposed below plane 3*a*—3*a*. FIG. 4*a* shows four salient corners of large radius; FIG. 5*a* shows four salient corners of medium radius; and FIG. 6*c* shows four salient corners of small radius.

The flow divider 32 is disposed below the transition and there is thus created two axis 35 and 37. The included angle of the flow divider is generally equivalent to the divergence angle of the exit walls 38 and 39.

The area in plane 3*a*—3*a* is greater than the area of the two angled exits 35 and 37; and the flow from exits 35 and 37 has a lesser velocity than the flow in circular pipe section 30*b*. This reduction in the mean velocity of flow reduces turbulence occasioned by liquid from the nozzle entering the mold.

The total deflection is the sum of that produced within main transition 34 and that provided by the divergence of the exit walls 38 and 39. It has been found that a total deflection angle of approximately 30 degrees is nearly optimum for the continuous casting of thin steel slabs having widths in the range from 975 to 1625 mm or 38 to 64 inches, and thicknesses in the range of 50 to 60 mm. The optimum deflection angle is dependent on the width of the slab and to some extent upon the length, width and depth of the mold bulge B. Typically the bulge may have a length of 800 to 1100 mm, a width of 150 to 200 mm and a depth of 700 to 800 mm.

Figure 2:
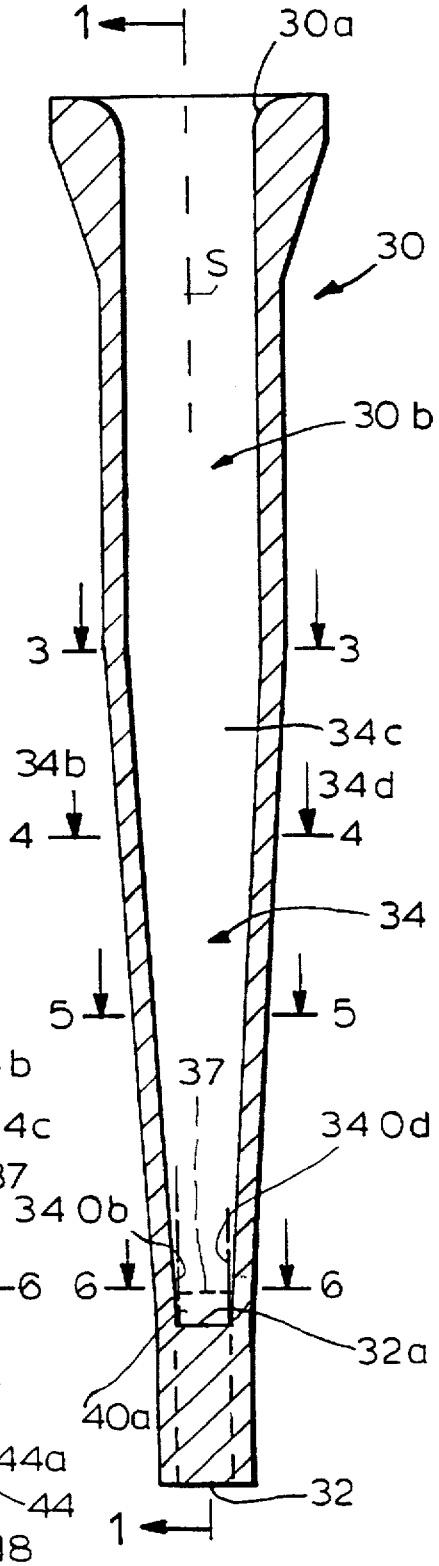
FIG. 2 is an axial sectional view looking to the right taken along the line 2—2 of FIG. 1.

Referring now to FIGS. 1 and 2, an alternative submerged entry nozzle is indicated generally by the reference numeral 30. The upper end of the nozzle includes an entry nozzle 30*a* terminating in a circular pipe 30*b* of 76 mm inside diameter which extends downwardly, as shown in FIGS. 1 and 2. The axis of pipe section 30*b* is considered as the axis S of the nozzle. Pipe section 30*b* terminates at the plane 3—3 which, as can be seen from FIG. 3, is of circular cross-section and has an area of 4536 $mm^2$. The flow then enters the main transition indicated generally by the reference numeral 34 and preferably having six walls 34*a* through 34*f*. Side walls 34*c* and 34*f* each diverge at an angle, preferably an angle of 10 degrees from the vertical. Front walls 34*d* and 34*e* are disposed at small angles relative to one another as are rear walls 34*a* and 34*b*. This is explained in detail subsequently. Front walls 34*d* and 34*e* converge with rear walls 34*a* and 34*b*, each at a mean angle of roughly 3.8 degrees from the vertical.

For a conical two-dimensional diffuser, it is customary to limit the included angle of the cone to approximately 8 degrees to avoid undue pressure loss due to incipient separation of flow. Correspondingly, for a one-dimensional rectangular diffuser, wherein one pair of opposed walls are parallel, the other pair of opposed walls should diverge at an included angle of not more than 16 degrees; that is, plus 8 degrees from the axis for one wall and minus 8 degrees from the axis for the opposite wall. In the diffusing main transition 34 of FIG. 1, the 3.8 degree mean convergence of the front and rear walls yields an equivalent one-dimensional divergence of the side walls of 10–3.8=6.2 degrees, approximately, which is less than the 8 degree limit.

FIGS. 4, 5 and 6 are cross-sections taken in the respective planes 4—4, 5—5 and 6—6 of FIGS. 1 and 2, which are respectively disposed 100, 200 and 351.6 mm below plane 3—3. The included angle between front walls 34e and 34d is somewhat less than 180 degrees as is the included angle between rear walls 34a and 34b. FIG. 4 shows four salient corners of large radius; FIG. 5 shows four salient corners of medium radius; and FIG. 6 shows four salient corners of small radius. The intersection of rear walls 34a and 34b may be provided with a filet or radius, as may the intersection of front walls 34d and 34e. The length of the flow passage is 111.3 mm in FIG. 4, 146.5 mm in FIG. 5, and 200 mm in FIG. 6.

Alternatively, as shown in FIG. 6a, the cross-section in plane 6—6 may have four salient corners of substantially zero radius. The front walls 34e and 34d and the rear walls 34a and 34b along their lines of intersection extend downwardly 17.6 mm below plane 6—6 to the tip 32a of flow divider 32. There is thus created two exits 35 and 37 respectively disposed at plus and minus 10 degree angles relative to the horizontal. Assuming that transition 34 has sharp salient corners in plane 6—6, as shown in FIG. 6a, each of the angled exits would be rectangular, having a slant length of 101.5 mm and a width of 28.4 mm, yielding a total area of 5776 $mm^2$.

The ratio of the area in plane 3—3 to the area of the two angled exits 35 and 37 is $\pi/4=0.785$; and the flow from exits 35 and 37 has 78.5% of the velocity in circular pipe section 30b. This reduction in the mean velocity of flow reduces turbulence occasioned by liquid from the nozzle entering the mold. The flow from exits 35 and 37 enters respective curved rectangular pipe sections 38 and 40. It will subsequently be shown that the flow in main transition 34 is substantially divided into two streams with higher fluid velocities adjacent side walls 34c and 34f and lower velocities adjacent the axis. This implies a bending of the flow in two opposite directions in main transition 34 approaching plus and minus 10 degrees. The curved rectangular pipes 38 and 40 bend the flows through further angles of 20 degrees. The curved sections terminate at lines 39 and 41. Downstream are respective straight rectangular pipe sections 42 and 44 which nearly equalize the velocity distribution issuing from the bending sections 38 and 40. Ports 46 and 48 are the exits of respective straight sections 42 and 44. It is desirable that the inner walls 38a and 40a of respective bending sections 38 and 40 have an appreciable radius of curvature, preferably not much less than half that of outer walls 38b and 40b. The inner walls 38a and 40a may have a radius of 100 mm; and outer walls 38b and 40b would have a radius of 201.5 mm. Walls 38b and 40b are defined by flow divider 32 which has a sharp leading edge with an included angle of 20 degrees. Divider 32 also defines walls 42b and 44b of the straight rectangular sections 42 and 44.

Figure 17:
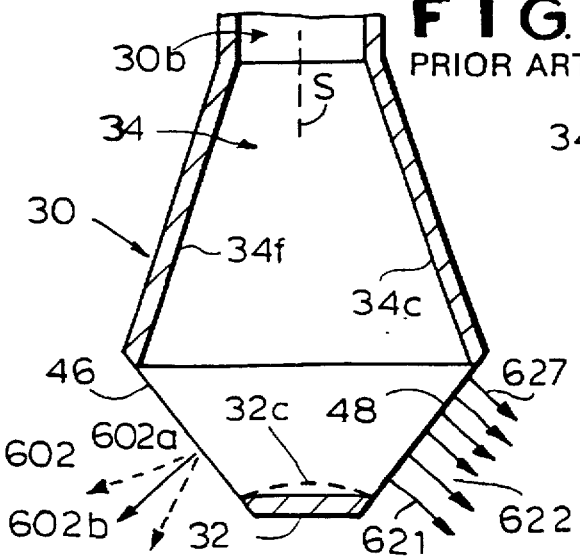
FIG. 17 PRIOR ART
FIG. 17 is an axial sectional view looking rearwardly of a prior art nozzle.
Figure 18:
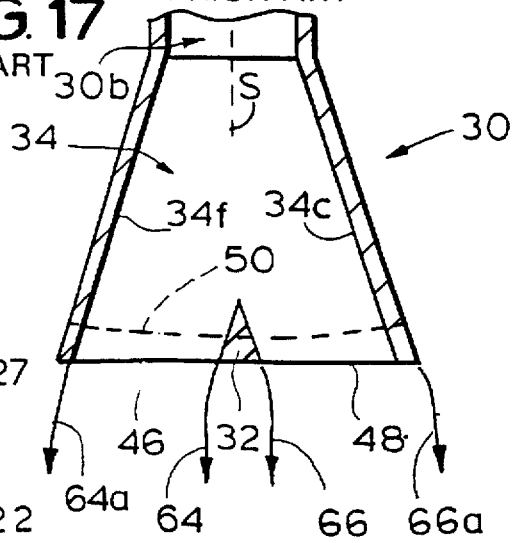
FIG. 18 PRIOR ART
FIG. 18 is an axial sectional view looking rearwardly of a further prior art nozzle.

It will be understood that adjacent inner walls 38a and 40a there is a low pressure and hence high velocity whereas adjacent outer walls 38b and 40b there is a high pressure and hence low velocity. It is to be noted that this velocity profile in curved sections 38 and 40 is opposite to that of the prior art nozzles of FIGS. 17 and 18. Straight sections 42 and 44 permit the high-velocity low-pressure flow adjacent inner walls 38a and 40a of bending sections 38 and 40 a reasonable distance along walls 42a and 44a within which to diffuse to lower velocity and higher pressure.

The total deflection is plus and minus 30 degrees comprising 10 degrees produced within main transition 34 and 20 degrees provided by the curved pipe sections 38 and 40. It has been found that this total deflection angle is nearly optimum for the continuous casting of steel slabs having widths in the range from 975 to 1625 mm or 38 to 64 inches. The optimum deflection angle is dependent on the width of the slab and to some extent upon the length, width and depth of the mold bulge B. Typically the bulge may have a length of 800 to 1100 mm, a width of 150 to 200 mm and a depth of 700 to 800 mm. Of course it will be understood that where the section in plane 6—6 is as shown in FIG. 6, pipe sections 38, 40, 42 and 44 would no longer be perfectly rectangular but would be only generally so. It will be further appreciated that in FIG. 6, side walls 34c and 34f may be substantially semi-circular with no straight portion. The intersection of rear walls 34a and 34b has been shown as being very sharp, as along a line, to improve the clarity of the drawings. In FIG. 2, 340b and 340d represent the intersection of side wall 34c with respective front and rear walls 34b and 34d, assuming square salient corners as in FIG. 6a. However, due to rounding of the four salient corners upstream of plane 6—6, lines 340b and 340d disappear. Rear walls 34a and 34b are oppositely twisted relative to one another, the twist being zero in plane 3—3 and the twist being nearly maximum in plane 6—6. Front walls 34d and 34e are similarly twisted. Walls 38a and 42a and walls 40a and 44a may be considered as flared extensions of corresponding side walls 34f and 34c of the main transition 34.

Referring now to FIG. 1a, there is shown on an enlarged scale a flow divider 32 provided with a rounded leading edge. Curved walls 38b and 40b are each provided with a radius reduced by 5 mm, for example, from 201.5 to 196.5 mm. This produces, in the example, a thickness of over 10 mm within which to fashion a rounded leading edge of sufficient radius of curvature to accommodate the desired range of stagnation points without producing laminar separation. The tip 32b of divider 32 may be semi-elliptical, with vertical semi-major axis. Preferably tip 32b has the contour of an airfoil such, for example, as an NACA 0024 symmetrical wing section ahead of the 30% chord position of maximum thickness. Correspondingly, the width of exits 35 and 37 may be increased by 1.5 mm to 29.9 mm to maintain an exit area of 5776 $mm^2$.

Referring now to FIGS. 7 and 8, the upper portion of the circular pipe section 30b of the nozzle has been shown broken away. At plane 3—3 the section is circular. Plane 16—16 is 50 mm below plane 3—3. The cross-section is rectangular, 76 mm long and 59.7 mm wide so that the total area is again 4536 $mm^2$. The circular-to-rectangular transition 52 between planes 3—3 and 16—16 can be relatively short because no diffusion of flow occurs. Transition 52 is connected to a 25 mm height of rectangular pipe 54, terminating at plane 17—17, to stabilize the flow from transition 52 before entering the diffusing main transition 34, which is now entirely rectangular. The main transition 34 again has a height of 351.6 mm between planes 17—17 and 6—6 where the cross-section may be perfectly hexagonal, as shown in FIG. 6a. The side walls 34c and 34f diverge at an angle of 10 degrees from the vertical, and the front walls and rear walls converge at a mean angle, in this case, of approximately 2.6 degrees from the vertical. The equivalent one-dimensional diffuser wall angle is now 10–2.6=7.4 degrees, approximately, which is still less than the generally used 8 degrees maximum. The rectangular pipe section 54 may be omitted, if desired, so that transition 52 is directly coupled to main transition 34. In plane 6—6 the length is again 200 mm and the width adjacent walls 34c and 34f is again 28.4 mm. At the centerline of the nozzle the width is somewhat greater. The cross-sections in planes 4—4 and 5—5 are similar to those shown in FIGS. 4 and 5 except that the four salient corners are sharp instead of rounded. The rear walls 34a and 34b and the front walls 34d and 34e intersect along lines which meet the tip 32a of flow divider 32 at a point 17.6 mm below plane 6—6. Angled rectangular exits 35 and 37 again each have a slant length of 101.5 mm and a width of 28.4 mm yielding a total exit area of 5776 $mm^2$. The twisting of front wall 34*b* and rear wall 34*d* is clearly seen in FIG. 8.

In FIGS. 7 and 8, as in FIGS. 1 and 2, the flows from exits 35 and 37 of transition 34 pass through respective rectangular turning sections 38 and 40, where the respective flows are turned through an additional 20 degrees relative to the vertical, and then through respective straight rectangular equalizing sections 42 and 44. The flows from sections 42 and 44 again have total deflections of plus and minus 30 degrees from the vertical. The leading edge of flow divider 32 again has an included angle of 20 degrees. Again it is preferable that the flow divider 32 has a rounded leading edge and a tip (32*b*) which is semi-elliptical or of airfoil contour as in FIG. 1*a*.

Figure 9:
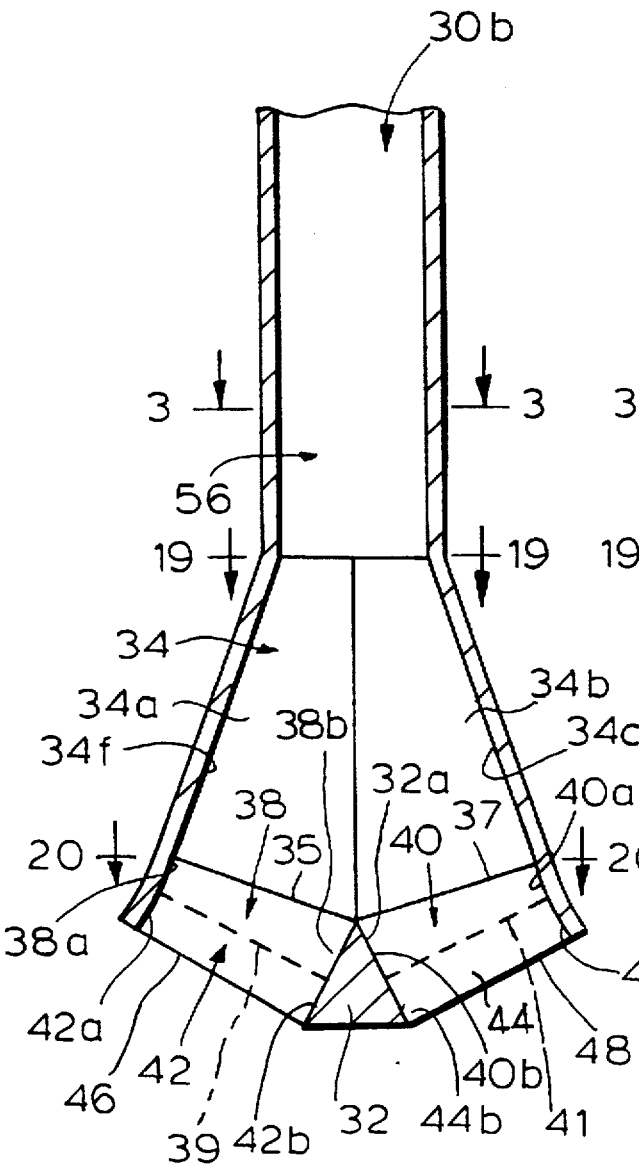
FIG. 9 is an axial sectional view looking rearwardly of a third submerged entry nozzle having a round-to-square transition with moderate diffusion, a hexagonal medium-angle diverging main transition with constant flow area, and low terminal bending.
Figure 10:
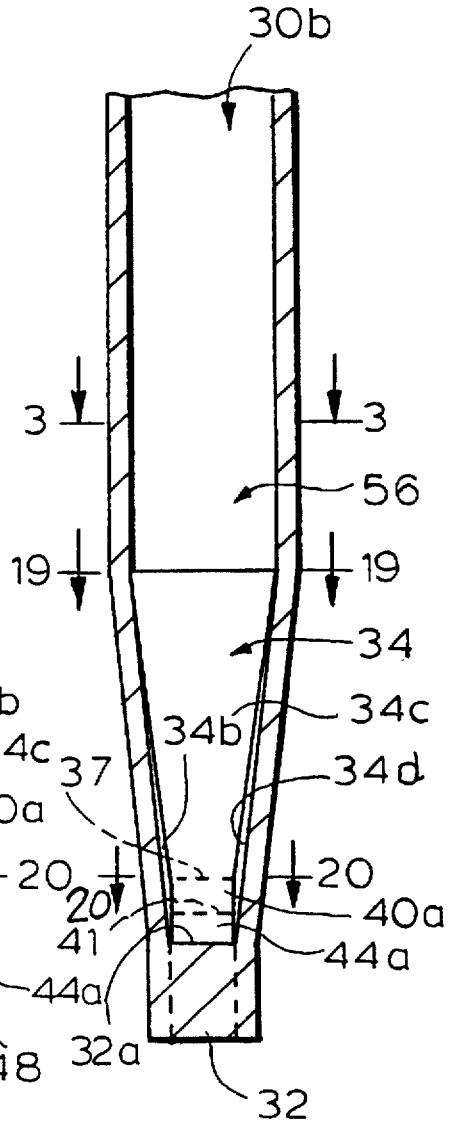
FIG. 10 is an axial sectional view looking to the right of the nozzle of FIG. 9.

Referring now to FIGS. 9 and 10, between planes 3—3 and 19—19 is a circular-to-square transition 56 with diffusion. The area in plane 19—19 is $76^2$=5776 $mm^2$. The distance between planes 3—3 and 19—19 is 75 mm; which is equivalent to a conical diffuser where the wall makes an angle of 3.5 degrees to the axis and the total included angle between walls is 7.0 degrees. Side walls 34*c* and 34*f* of transition 34 each diverge at an angle of 20 degrees from the vertical while rear walls 34*a*–34*b* and front-walls 34*a*–34*e* converge in such a manner as to provide a pair of rectangular exit ports 35 and 37 disposed at 20 degree angles relative to the horizontal. Plane 20—20 lies 156.6 mm below plane 19—19. In this plane the length between walls 34*c* and 34*f* is 190 mm. The lines of intersection of the rear walls 34*a*–34*b* and of the front walls 34*a*–34*e* extend 34.6 mm below plane 20—20 to the tip 32*a* of divider 32. The two angled rectangular exit ports 35 and 37 each have a slant length of 101.1 mm and a width of 28.6 mm yielding an exit area of 5776 $mm^2$ which is the same as the entrance area of the transition in plane 19—19. There is no net diffusion within transition 34. At exits 35 and 37 are disposed rectangular turning sections 38 and 40 which, in this case, deflect each of the flows only through an additional 10 degrees. The leading edge of flow divider 32 has an included angle of 40 degrees. Turning sections 38 and 40 are followed by respective straight rectangular sections 42 and 44. Again, the inner walls 38*a* and 40*a* of sections 38 and 40 may have a radius of 100 mm which is nearly half of the 201.1 mm radius of the outer walls 38*b* and 40*b*. The total deflection is again plus and minus 30 degrees. Preferably flow divider 32 is provided with a rounded leading edge and a tip (32*b*) which is semi-elliptical or of airfoil contour by reducing the radii of walls 38*b* and 40*b* and, if desired, correspondingly increasing the width of exits 35 and 37.

Figure 11:
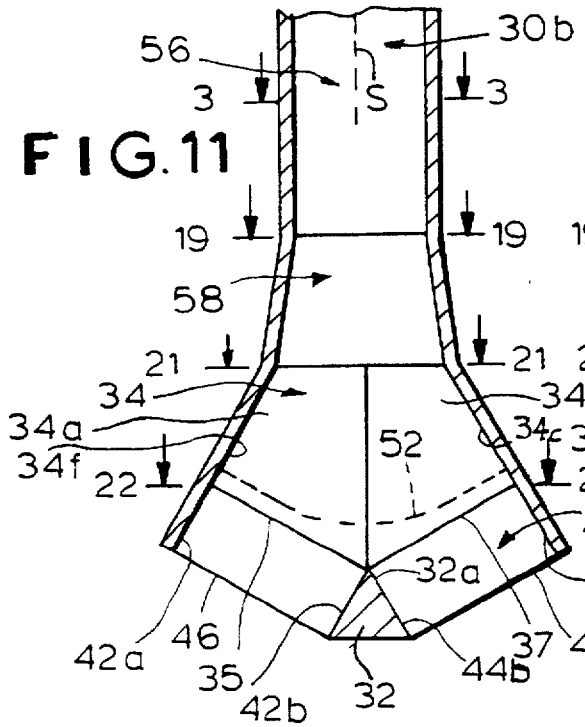
FIG. 11 is an axial sectional view looking rearwardly of a fourth submerged entry nozzle providing round-to-square and square-to-rectangular transitions of high total diffusion, a hexagonal high-angle diverging main transition with decreasing flow area, and no terminal bending.
Figure 12:
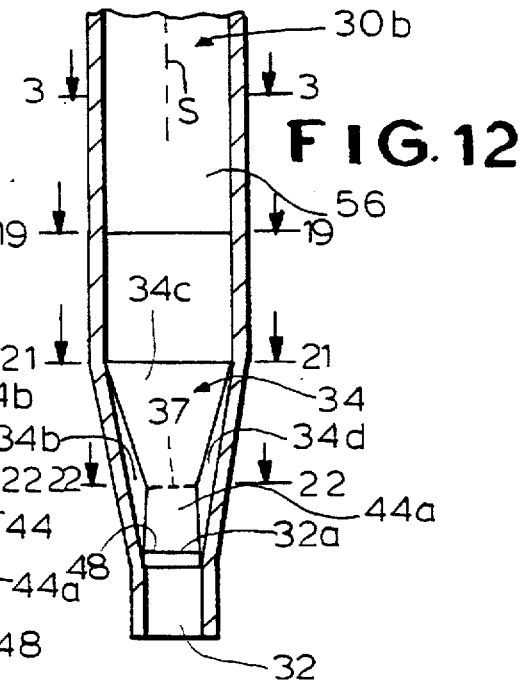
FIG. 12 is an axial sectional view looking to the right of the nozzle of FIG. 11.

Referring now to FIGS. 11 and 12, in plane 3—3 the cross-section is again circular; and in plane 19—19 the cross-section is square. Between planes 3—3 and 19—19 is a circular-to-square transition 56 with diffusion. Again, separation in the diffuser 56 is obviated by making the distance between planes 3—3 and 19—19 75 mm. Again the area in plane 19—19 is $76^2$=5776 $mm^2$. Between plane 19—19 and plane 21—21 is a one-dimensional square-to-rectangular diffuser. In plane 21—21 the length is $(4/\pi)76$= 96.8 mm and the width is 76 mm, yielding an area of 7354 $mm^2$. The height of diffuser 58 is also 75 mm; and its side walls diverge at 7.5 degree angles from the vertical. In main transition 34, the divergence of each of side walls 34*c* and 34*f* is now 30 degrees from the vertical. To ensure against flow separation with such large angles, transition 34 provides a favorable pressure gradient wherein the area of exit ports 35 and 37 is less than in the entrance plane 21—21. In plane 22—22, which lies 67.8 mm below plane 21—21, the length between walls 34*c* and 34*f* is 175 mm. Angled exit ports 35 and 37 each have a slant length of 101.0 mm and a width of 28.6 mm, yielding an exit area of 5776 $mm^2$. The lines of intersection of rear walls 34*a*–34*b* and front walls 34*d*–34*e* extend 50.5 mm below plane 22—22 to the tip 32*a* of divider 32. At the exits 35 and 37 of transition 34 are disposed two straight rectangular sections 42 and 44. Sections 42 and 44 are appreciably elongated to recover losses of deflection within transition 34. There are no intervening turning sections 38 and 40; and the deflection is again nearly plus and minus 30 degrees as provided by main transition 34. Flow divider 32 is a triangular wedge having a leading edge included angle of 60 degrees. Preferably divider 32 is provided with a rounded leading edge and a tip (32*b*) which is of semi-elliptical or airfoil contour, by moving walls 42*a* and 42*b* outwardly and thus increasing the length of the base of divider 32. The pressure rise in diffuser 58 is, neglecting friction, equal to the pressure drop which occurs in main transition 34. By increasing the width of exits 35 and 37, the flow velocity can be further reduced while still achieving a favorable pressure gradient in transition 34.

In FIG. 11, 52 represents an equipotential of flow near exits 35 and 37 of main transition 34. It will be noted that equipotential 52 extends orthogonally to walls 34*c* and 34*f*, and here the curvature is zero. As equipotential 52 approaches the center of transition 34, the curvature becomes greater and greater and is maximum at the center of transition 34, corresponding to axis S. The hexagonal cross-section of the transition thus provides a turning of the flow streamlines within transition 34 itself. It is believed the mean deflection efficiency of a hexagonal main transition is more than ⅔ and perhaps ¾ or 75% of the apparent deflection produced by the side walls.

In FIGS. 1–2 and 7–8 the 2.5 degrees loss from 10 degrees in the main transition is almost fully recovered in the bending and straight sections. In FIGS. 9–10 the 5 degrees loss from 20 degrees in the main transition is nearly recovered in the bending and straight sections. In FIGS. 11–12 the 7.5 degrees loss from 30 degrees in the main transition is mostly recovered in the elongated straight sections.

Figure 13:
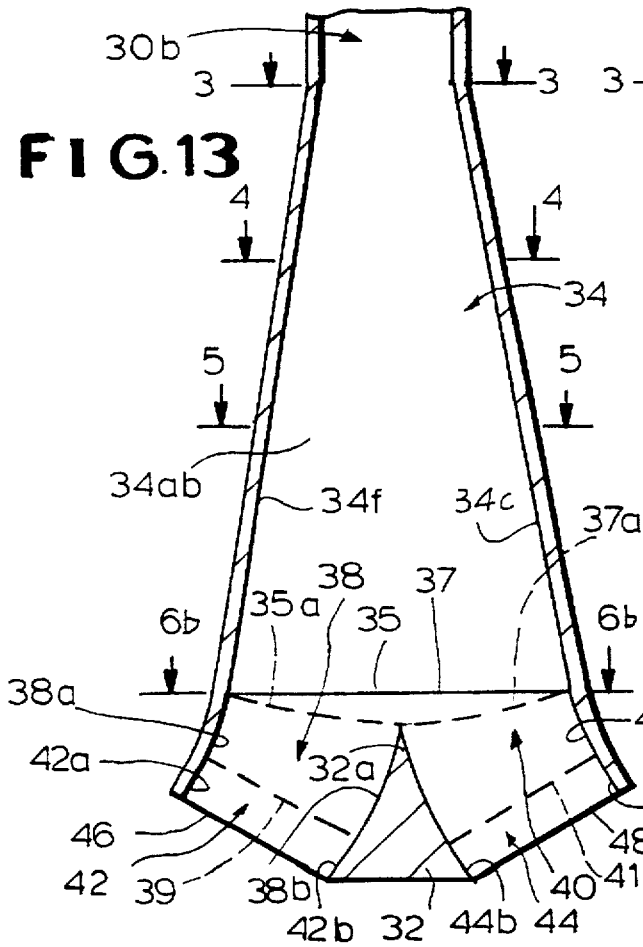
FIG. 13 is an axial sectional view looking rearwardly of a fifth submerged entry nozzle similar to that of FIG. 1 but having a rectangular main transition.
Figure 14:
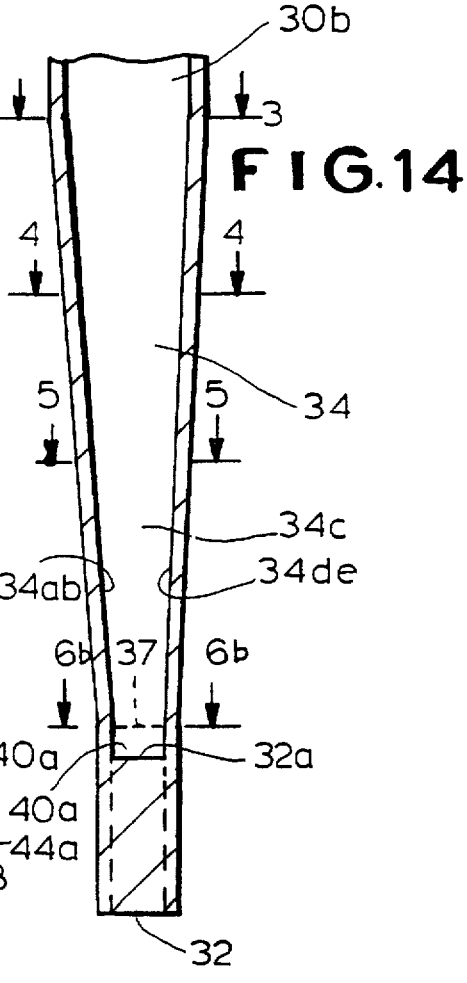
FIG. 14 is an axial sectional view looking to the right of the nozzle of FIG. 13.

Referring now to FIGS. 13 and 14, there is shown a variant of FIGS. 1 and 2 wherein the main transition 34 is provided with only four walls, the rear wall being 34*ab* and the front wall being 34*de*. The cross-section in plane 6—6 may be generally rectangular as shown in FIG. 6*b*. Alternatively, the cross-section may have sharp corners of zero radius. Alternatively, the side walls 34*c* and 34*f* may be of semi-circular cross-section with no straight portion, as shown in FIG. 17*b*. The cross-sections in planes 4—4 and 5—5 are generally as shown in FIGS. 4 and 5 except, of course, rear walls 34*a* and 34*b* are colinear as well as front walls 34*e* and 34*d*. Exits 35 and 37 both lie in plane 6—6. The line 35*a* represents the angled entrance to turning section 38; and the line 37*a* represents the angled entrance to turning section 40. Flow divider 32 has a sharp leading edge with an included angle of 20 degrees. The deflections of flow in the left-hand and right-hand portions of transition 34 are perhaps 20% of the 10 degree angles of side walls 34*c* and 34*f*, or mean deflections of plus and minus 2 degrees. The angled entrances 35*a* and 37*a* of turning sections 38 and 40 assume that the flow has been deflected 10 degrees within transition 34. Turning sections 38 and 40 as well as the following straight sections 42 and 44 will recover most of the 8 degree loss of deflection within transition 34; but it is not to be expected that the deflections from ports 46 and 48 will be as great as plus and minus 30 degrees. Divider 32 preferably has a rounded leading edge and a tip (32*b*) which is semi-elliptical or of airfoil contour as in FIG. 1*a*.

Figure 15:
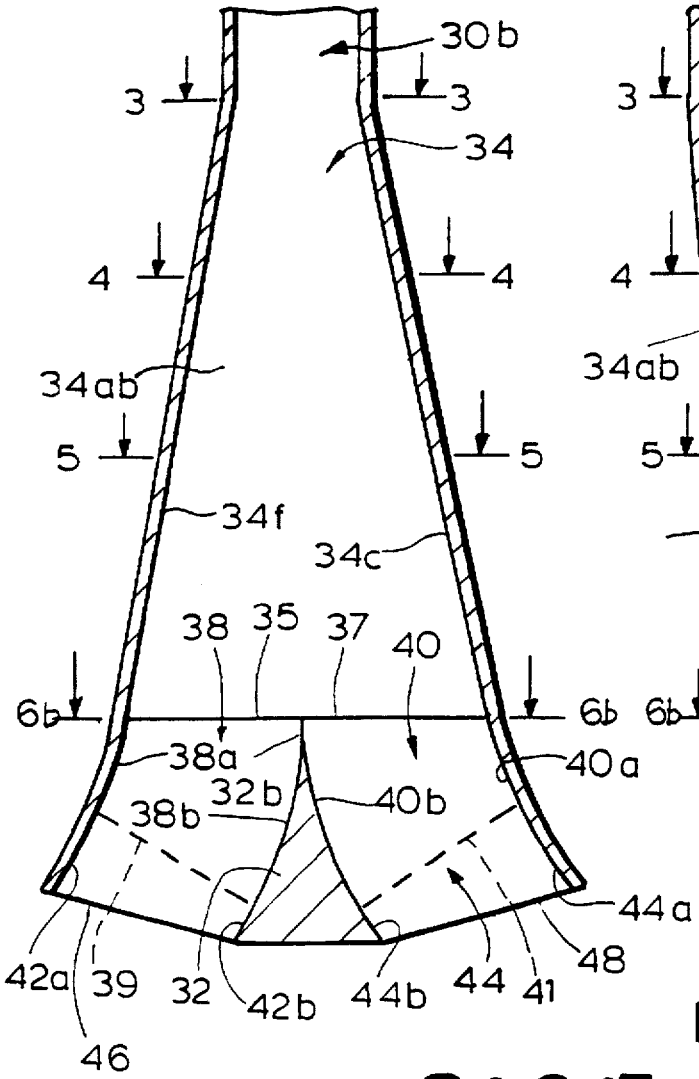
FIG. 15 is an axial sectional view looking rearwardly of a sixth submerged entry nozzle having a rectangular small-angle diverging main transition with diffusion, minor flow deflection within the main transition, and high terminal bending.
Figure 16:
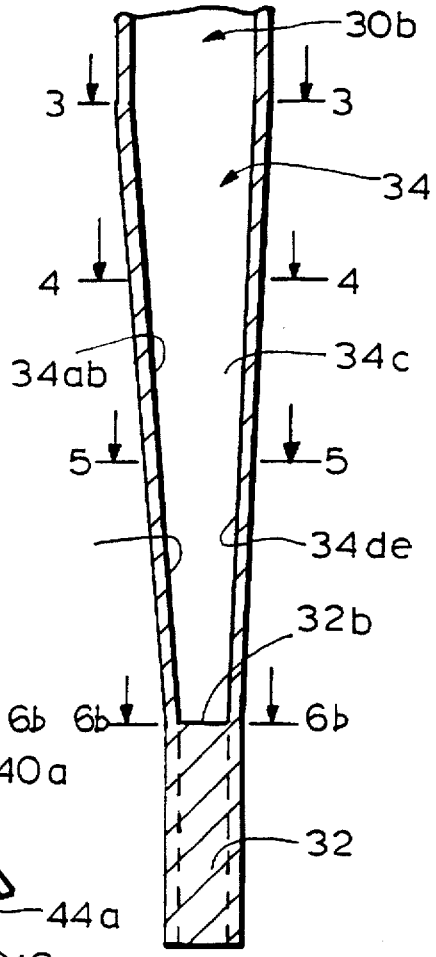
FIG. 16 is an axial sectional view looking to the right of the nozzle of FIG. 15.

Referring now to FIGS. 15 and 16, there is shown a further nozzle similar to that shown in FIGS. 1 and 2. Transition 34 again has only four walls, the rear wall being 34*ab* and the front wall being 34*de*. The cross-section in plane 6—6 may have rounded corners as shown in FIG. 6*b* or may alternatively be rectangular with sharp corners. The cross-sections in planes 4—4 and 5—5 are generally as shown in FIGS. 4 and 5 except rear walls 34*a*–34*b* are colinear as are front walls 34*d*–34*e*. Exits 35 and 37 both lie in plane 6—6. In this embodiment of the invention, the deflection angles at exits 35–37 are assumed to be zero degrees. Turning sections 38 and 40 each deflect their respective flows through 30 degrees. In this case, if flow divider 32 were to have a sharp leading edge, it would be in the nature of a cusp with an included angle of zero degrees, which construction would be impractical. Accordingly, walls 38*b* and 40*b* have a reduced radius so that the leading edge of the flow divider 32 is rounded and the tip (32*b*) is semi-elliptical or preferably of airfoil contour. The total deflection is plus and minus 30 degrees as provided solely by turning sections 38 and 40. Outlet ports 46 and 48 of straight sections 42 and 44 are disposed at an angle from the horizontal of less than 30 degrees, which 20 is the flow deflection from the vertical.

Walls 42*a* and 44*a* are appreciably longer than walls 42*b* and 44*b*. Since the pressure gradient adjacent walls 42*a* and 44*a* is unfavorable, a greater length is provided for diffusion. The straight sections 42 and 44 of FIGS. 15–16 may be used in FIGS. 1–2, 7–8, 9–10, and 13–14. Such straight sections may also be used in FIGS. 11–12; but the benefit would not be as great. It will be noted that for the initial one-third of turning sections 38 and 40 walls 38*a* and 40*a* provide less apparent deflection than corresponding side walls 34*f* and 34*c*. However, downstream of this, flared walls 38*a* and 40*a* and flared walls 42*a* and 44*a* provide more apparent deflection than corresponding side walls 34*f* and 34*c*.

In an initial design similar to FIGS. 13 and 14 which was built and successfully tested, side walls 34*c* and 34*f* each had a divergence angle of 5.2 degrees from the vertical; and rear wall 34*ab* and front wall 34*de* each converged at an angle of 2.65 degrees from the vertical. In plane 3—3, the flow cross-section was circular with a diameter of 76 mm. In plane 4—4, the flow cross-section was 95.5 mm long and 66.5 mm wide with radii of 28.5 mm for the four corners. In plane 5—5 the cross-section was 115 mm long and 57.5 mm wide with radii of 19 mm for the corners. In plane 6—6, which was disposed 150 mm, instead of 151.6 mm, below plane 5—5, the cross-section was 144 mm long and 43.5 mm wide with radii of 5 mm for the corners; and the flow area was 6243 $mm^2$. Turning sections 38 and 40 were omitted. Walls 42*a* and 44*a* of straight sections 40 and 42 intersected respective side walls 34*f* and 34*c* in plane 6—6. Walls 42*a* and 44*a* again diverged at 30 degrees from the vertical and were extended downwardly 95 mm below plane 6—6 to a seventh horizontal plane. The sharp leading edge of a triangular flow divider 32 having an included angle of 60 degrees (as in FIG. 11) was disposed in this seventh plane. The base of the divider extended 110 mm below the seventh plane. The outlet ports 46 and 48 each had a slant length of 110 mm. It was found that the tops of ports 46 and 48 should be submerged at least 150 mm below the meniscus. At a casting rate of 3.3 tons per minute with a slab width of 1384 mm, the height of standing waves was only 7 to 12 mm; no surface vortices formed in the meniscus; no oscillation was evident for mold widths less than 1200 mm; and for mold width greater than this, the resulting oscillation was minimal. It is believed that this minimal oscillation for large mold widths may result from flow separation on walls 42*a* and 44*a*, because of the extremely abrupt terminal deflection, and because of flow separation downstream of the sharp leading edge of flow divider 32. In this initial design, the 2.65 degree convergence of the front and rear walls 34*ab* and 34*de* was continued in the elongated straight sections 42 and 44. Thus these sections were not rectangular with 5 mm radius corners but were instead slightly trapezoidal, the top of outlet ports 46 and 48 had a width of 35 mm and the bottom of outlet ports 46 and 48 had a width of 24.5 mm. We consider that a section which is slightly trapezoidal is generally rectangular.

It will be seen that we have accomplished the objects of our invention. By providing diffusion and deceleration of flow velocity between the inlet pipe and the outlet ports, the velocity of flow from the ports is reduced, velocity distribution along the length and width of the ports is rendered generally uniform, and standing wave oscillation in the mold is reduced. Deflection of the two oppositely directed streams is accomplished by providing a flow divider which is disposed below the transition from axial symmetry to planar symmetry. By diffusing and decelerating the flow in the transition, a total stream deflection of approximately plus and minus 30 degrees from the vertical can be achieved while providing stable, uniform velocity outlet flows.

In addition, deflection of the two oppositely directed streams can be accomplished in part by providing negative pressures at the outer portions of the streams. These negative pressures are produced in part by increasing the divergence angles of the side walls downstream of the main transition. Deflection can be provided by curved sections wherein the inner radius is an appreciable fraction of the outer radius. Deflection of flow within the main transition itself can be accomplished by providing the transition with a hexagonal cross-section having respective pairs of front and rear walls which intersect at included angles of less than 180 degrees. The flow divider is provided with a rounded leading edge of sufficient radius of curvature to prevent vagaries in stagnation point due either to manufacture or to slight flow oscillation from producing a separation of flow at the leading edge which extends appreciably downstream.

It will be understood that certain features and subcombinations are of utility and may be employed without reference to other features of subcombinations. This is contemplated by and is within the scope of our claims. It is therefore to be understood that our invention is not to be limited to the specific details shown and described.

Having thus described our invention, what we claim is:

1. A submerged entry nozzle for flowing liquid metal therethrough, comprising; a vertically disposed entrance pipe section having a generally axial symmetry and a first cross-sectional flow area; a diffusing transition section in fluid communication with the pipe section including two or more front walls and two or more side walls, the front walls converging in a first vertical plane and the side walls diverging in a second vertical plane perpendicular to the first vertical plane to substantially continuously change the nozzle's cross-sectional flow area in the transition section from the first cross-sectional flow area to a generally elongated second cross-sectional flow area which is greater in cross-sectional flow area than the first cross-sectional flow area and to substantially continuously change the nozzle's symmetry in the transition section from the generally axial symmetry to a generally planar symmetry; and a divider section in fluid communication with the transition section to divide the flow of liquid metal from the transition section into two streams angularly deflected from the vertical in opposite directions.

2. A nozzle as in claim 1 wherein the transition section provides a substantial decrease in flow velocity.

3. A nozzle as in claim 1 wherein the divider section includes a pair of deflecting sections including a flow divider between the deflecting sections disposed downstream of the transition section, the deflecting sections having side walls which diverge from the vertical at a certain angle which are generally parallel to the side walls provided by the flow divider.

4. A nozzle as in claim 1 wherein the front walls converge at a total included convergent angle of the front walls of about 2.0 to 8.6 degrees.

5. A nozzle as in claim 1 wherein the side walls converge at a total included divergent angle of the side walls of about 16.6 to 6.0 degrees.

6. A nozzle as in claim 3 wherein the deflecting sections provide a deflecting angle from the vertical in the range of about 10 to 80 degrees on each side.

7. A nozzle as in claim 3 wherein the deflecting sections provide a deflecting angle from the vertical in the range of about 20 to 40 degrees.

8. A nozzle as in claim 4 wherein the total included convergent angle is approximately 5.3 degrees.

9. A nozzle as in claim 5 wherein the total included divergent angle is approximately 10.4 degrees.

10. A nozzle as in claim 2 wherein the transition provides a decrease in flow velocity and an increase in cross-sectional area of approximately 38%.

11. A submerged entry nozzle for continuously casting molten steel including in combination a vertically disposed entrance pipe section having a certain cross-sectional flow area, and means for dividing flow from the entrance pipe section into two streams angularly deflected from the vertical in opposite directions and having substantially equal certain cross-sectional flow areas, the flow dividing means including a transition having a cross-sectional flow area which is generally hexagonal, means including the transition for enlarging the cross-sectional flow area such that the sum of the certain flow areas of the two streams is appreciably greater than said certain flow area of the entrance pipe section, first means disposed between the streams for producing positive pressures on the inner portions of the streams, the first means having a rounded leading edge of a sufficiently large radius of curvature to permit variation in stagnation point without flow separation, and means for producing negative pressures on the outer portions of the streams.

12. A submerged entry nozzle for continuously casting molten steel including in combination a vertically disposed entrance pipe section having a certain cross-sectional flow area, and means for dividing flow from the entrance pipe section into two streams angularly deflected from the vertical in opposite directions, the flow dividing means including first means disposed between the streams for providing positive pressures on the inner portions of the streams and second means for producing negative pressures on the outer portions of the streams.

13. A nozzle as in claim 12 wherein the flow dividing means comprises a transition having side walls which diverge at a certain angle from the vertical and wherein the first and second means comprise a pair of deflecting sections disposed downstream of the transition, the deflecting sections having respective walls corresponding to said transition side walls, and the deflecting sections having respective terminal portions at which said corresponding walls diverge at an angle from the vertical appreciably greater than said certain angle.

14. A nozzle as in claim 12 wherein the first and second means comprise a pair of substantially straight and generally rectangular sections.

15. A nozzle as in claim 12 wherein the first and second means comprise a pair of curved and generally rectangular sections.

16. A nozzle as in claim 15 wherein the curved sections have inner and outer walls of certain radii, the inner walls having a radius not appreciably less than half that of the outer walls.

17. A nozzle as in claim 15 wherein the first and second means further comprise a pair of substantially straight and generally rectangular sections disposed downstream of the curved sections.

18. A submerged entry nozzle for continuously casting molten steel including in combination a vertically disposed entrance pipe section having a certain cross-sectional flow area, means including a transition for reducing the velocity of flow from the entrance pipe section, the transition having side walls which diverge at a certain angle from the vertical and having an outlet cross-sectional flow area appreciably greater than said certain area, and means for dividing flow from the transition into two streams angularly deflected from the vertical in opposite directions.

19. A nozzle as in claim 18 wherein the transition provides a substantial decrease in flow velocity.

20. A nozzle as in claim 18 wherein the transition provides substantially no net change in flow velocity and wherein the flow velocity reducing means includes a diffuser disposed upstream of the transition.

21. A nozzle as in claim 18 wherein the transition provides an increase in flow velocity and wherein the flow velocity reducing means includes diffusing means disposed upstream of the transition for providing a decrease in flow velocity of appreciably greater magnitude than the increase in flow velocity provided by the transition.

22. A submerged entry nozzle for continuously casting molten steel including in combination a vertically disposed entrance pipe section having a certain cross-sectional flow area, and means for dividing flow from the entrance pipe section into two streams angularly deflected from the vertical in opposite directions, the flow dividing means being disposed between the streams and having a rounded leading edge of a sufficiently large radius of curvature to permit variation in stagnation point without flow separation.

23. A nozzle as in claim 22 wherein the flow dividing means includes a tip portion which is generally of semi-elliptical contour.

24. A nozzle as in claim 22 wherein the flow dividing means includes a tip portion which has generally the contour of a symmetrical wing section ahead of the chord position of maximum thickness.

25. A submerged entry nozzle for continuously casting molten steel comprising in combination a vertically disposed entrance pipe section having a certain cross-sectional flow area, and means for dividing flow from the entrance pipe section into two streams angularly deflected from the vertical in opposite directions, the flow dividing means including a transition having a cross-sectional flow area which is generally hexagonal and a pair of substantially straight and generally rectangular sections disposed downstream of the transition, wherein the straight sections direct the streams at a certain angle from the vertical, and have outlet ports disposed at an angle from the horizontal which is less than said certain angle.

26. A submerged entry nozzle for continuously casting molten steel comprising in combination a vertically disposed entrance pipe section having a certain cross-sectional flow area, and means for dividing flow from the entrance pipe section into two streams angularly deflected from the vertical in opposite directions, the flow dividing means including a transition having a cross-sectional flow area which is generally hexagonal and a pair of curved and generally rectangular sections disposed downstream of the transition.

27. A submerged entry nozzle for continuously casting molten steel comprising in combination a vertically disposed entrance pipe section having a certain cross-sectional flow area, and means for dividing flow from the entrance pipe section into two streams angularly deflected from the vertical in opposite directions, the flow dividing means including a transition having a cross-sectional flow area which is generally hexagonal, a pair of curved and generally rectangular sections disposed downstream of the transition and a pair of substantially straight and generally rectangular sections disposed downstream of the curved sections.

28. A nozzle as in claim 14 wherein the straight sections direct the streams at a certain angle from the vertical, the straight sections having outlet ports disposed at an angle from the horizontal which is less than said certain angle.

29. A nozzle as in claim 1 wherein the first cross-sectional area is substantially circular.

30. A submerged entry nozzle for flowing liquid metal therethrough, comprising; a vertically disposed entrance pipe section having a first cross-sectional flow area and a generally axial symmetry; a diffusing transition section in fluid communication with the pipe section, the transition section adapted and arranged to substantially continuously change the nozzle's cross-sectional flow area in the transition section from the first cross-sectional flow area to a generally elongated second cross-sectional flow area which is greater in cross-sectional flow area than the first cross-sectional flow area, and to substantially continuously change the nozzle's symmetry in the transition section from the generally axial symmetry to a generally planar symmetry; and a divider section in fluid communication with the transition section to divide the flow of liquid metal from the transition section into two streams angularly deflected from the vertical in substantially opposite directions.

31. A nozzle as in claim 1 wherein the front walls converge at a total included convergent angle and the side walls converge at a total included divergent angle and the difference between the total included divergent angle of the side walls and the total included convergent angle of the front walls is less than about eight degrees.

32. A nozzle as in claim 3 wherein the deflecting sections provide a deflecting angle from the vertical of about 30 degrees on each side.

33. The submerged entry nozzle of claim 1, wherein the nozzle's symmetry is substantially hexagonal.

34. The submerged entry nozzle of claim 30, wherein the nozzle's symmetry is substantially hexagonal.

* * * * *